US011208836B2

(12) United States Patent
Goldmann

(10) Patent No.: US 11,208,836 B2
(45) Date of Patent: Dec. 28, 2021

(54) DRIVE ARRANGEMENT

(71) Applicant: Brose Fahrzeugteile GmbH & Co. Kommanditgesellschaft, Bamberg, Bamberg (DE)

(72) Inventor: Thomas Goldmann, Bayreuth (DE)

(73) Assignee: Brose Fahrzeugteile GmbH SE & Co. Kommanditgesellschaft, Bamberg, Bamberg (DE)

( * ) Notice: Subject to any disclaimer, the term of this patent is extended or adjusted under 35 U.S.C. 154(b) by 0 days.

(21) Appl. No.: 16/033,363

(22) Filed: Jul. 12, 2018

(65) Prior Publication Data

US 2019/0017307 A1 Jan. 17, 2019

(30) Foreign Application Priority Data

Jul. 12, 2017 (DE) ..... 10 2017 115 586.4

(51) Int. Cl.
*E05F 15/48* (2015.01)
*E05F 1/10* (2006.01)
*E05F 15/622* (2015.01)

(52) U.S. Cl.
CPC ..... *E05F 1/105* (2013.01); *E05F 1/1091* (2013.01); *E05F 15/48* (2015.01); *E05F 15/622* (2015.01);
(Continued)

(58) Field of Classification Search
CPC ..... E05F 15/43; E05F 15/63; E05F 1/1091; E05F 15/627; B62D 25/10; B60J 5/10; H02H 7/0851
See application file for complete search history.

(56) References Cited

U.S. PATENT DOCUMENTS 4,289,995 A 9/1981 Sorber et al.
5,119,739 A 6/1992 Templeton et al.
(Continued)

FOREIGN PATENT DOCUMENTS

DE 19631861 11/1999
DE 102004017264 11/2004
(Continued)

OTHER PUBLICATIONS

"Chinese Search Report," for CN App. 200980145635.8, dated Apr. 19, 2013 (2 pages).
(Continued)

*Primary Examiner* — Rina I Duda
(74) *Attorney, Agent, or Firm* — Pauly, DeVries Smith & Deffner LLC

(57) ABSTRACT

The disclosure relates to a drive arrangement for movement of a tailgate, wherein at least one drive unit is provided, having two drive connections, wherein a first drive unit is motor and spring-operated and has a drive unit motor as well as a drive unit spring, respectively acting on the two drive connections associated with the first drive unit, wherein the first drive unit comprises a movement sensor, representing movement information regarding a movement between the drive connections, wherein a second drive unit is spring-operated and has a drive unit spring, acting on the two drive connections associated with the second drive unit, wherein a drive unit controller is provided, which detects a predetermined deviation of the sensor signal of the movement sensor from a predetermined normal signal corresponding to the normal condition as an error condition and upon detecting an error condition carries out an error routine.

16 Claims, 4 Drawing Sheets

(52) U.S. Cl.
CPC ..... *E05F 1/1058* (2013.01); *E05Y 2201/43* (2013.01); *E05Y 2201/474* (2013.01); *E05Y 2201/478* (2013.01); *E05Y 2400/302* (2013.01); *E05Y 2400/33* (2013.01); *E05Y 2400/508* (2013.01); *E05Y 2400/514* (2013.01); *E05Y 2400/814* (2013.01); *E05Y 2400/818* (2013.01); *E05Y 2800/00* (2013.01); *E05Y 2800/23* (2013.01); *E05Y 2800/236* (2013.01); *E05Y 2800/404* (2013.01); *E05Y 2900/546* (2013.01)

(56) References Cited

U.S. PATENT DOCUMENTS

| | | | | |
|---|---|---|---|---|
| 5,563,483 | A * | 10/1996 | Kowall | E05B 81/14 318/266 |
| 5,982,126 | A * | 11/1999 | Hellinga | B60J 5/06 318/286 |
| 6,168,217 | B1 * | 1/2001 | Kruger | E05B 81/22 292/201 |
| 6,185,868 | B1 * | 2/2001 | Kato | E05F 15/627 192/35 |
| 6,293,050 | B1 * | 9/2001 | Johnk | E05F 1/1091 49/276 |
| 6,398,288 | B1 | 6/2002 | Yuge | |
| 6,516,567 | B1 | 2/2003 | Stone et al. | |
| 6,719,356 | B2 * | 4/2004 | Cleland | E05F 1/1091 296/146.8 |
| 7,070,226 | B2 * | 7/2006 | Cleland | E05F 1/1091 296/146.8 |
| 7,071,644 | B2 | 7/2006 | Kawanobe | |
| 7,219,945 | B1 | 5/2007 | Mckeon et al. | |
| 8,027,769 | B2 * | 9/2011 | Oualkadi | E05F 15/41 701/49 |
| 8,156,838 | B2 * | 4/2012 | Batosky | E05F 15/622 74/424.71 |
| 8,234,817 | B2 * | 8/2012 | Neundorf | E05B 81/20 49/280 |
| 8,393,237 | B2 * | 3/2013 | Arenz | E05F 15/622 74/89.23 |
| 9,845,631 | B2 | 12/2017 | Eggeling et al. | |
| 2003/0030299 | A1 * | 2/2003 | Cleland | E05F 15/43 296/146.8 |
| 2004/0061468 | A1 | 4/2004 | Kurosawa et al. | |
| 2004/0172883 | A1 * | 9/2004 | Rogers | E05F 15/63 49/341 |
| 2004/0212334 | A1 | 10/2004 | Kawanobe | |
| 2006/0181108 | A1 * | 8/2006 | Cleland | E05F 15/43 296/146.4 |
| 2007/0114956 | A1 | 5/2007 | Hashimoto | |
| 2007/0137331 | A1 | 6/2007 | Kachouh | |
| 2008/0276537 | A1 | 11/2008 | Hanna et al. | |
| 2011/0271595 | A1 | 11/2011 | Eggeling et al. | |
| 2011/0314739 | A1 * | 12/2011 | Kaburaki | E05F 15/63 49/70 |
| 2015/0096233 | A1 * | 4/2015 | Kojima | E05F 15/40 49/31 |

FOREIGN PATENT DOCUMENTS

| | | |
|---|---|---|
| DE | 202005003466 | 8/2006 |
| DE | 202005007155 | 10/2006 |
| DE | 202007002306 | 7/2008 |
| DE | 102008022870 | 6/2009 |
| DE | 102008010249 | 8/2009 |
| DE | 102008057014 | 5/2010 |
| EP | 0961863 | 12/1999 |
| GB | 2400890 | 10/2004 |
| JP | 10184187 | 7/1998 |
| JP | 2002227522 | 8/2002 |
| JP | 2004324264 | 11/2004 |
| WO | 9928583 | 6/1999 |

OTHER PUBLICATIONS

"File History" for U.S. Appl. No. 13/128,826 downloaded Jul. 20, 2018 (556 pages).
"German Search Report," for Priority Application, dated Jul. 3, 2009 (3 pages).
"German Search Report," for Priority Application dated May 9, 2018 (9 pages).
"International Preliminary Reporton Patentability," for PCT App. PCT/EP2009/007222, dated May 17, 2011 (5 pages).

* cited by examiner

DRIVE ARRANGEMENT

CLAIM OF PRIORITY

This application claims the benefit of German Patent application No. DE 10 2017 115 586.4 filed on Jul. 12, 2017, the disclosure of which is incorporated herein by reference.

FIELD OF THE TECHNOLOGY

The disclosure relates to a drive arrangement for the motorized movement of a tailgate of a motor vehicle as well as a tailgate arrangement with such a drive arrangement as described herein.

BACKGROUND

Tailgates of motor vehicles are increasingly being outfitted with a drive arrangement of this kind, in order to provide a motorized movement of the tailgate between a closed position and an open position.

It is basically known how to employ a purely motor-operated drive unit together with a purely spring-operated drive unit in order to reduce the required motor power and thus the costs. The purely spring-operated drive unit, which is often designed as a gas pressure spring, usually works against the weight of the tailgate.

In view of the often heavy weight of the tailgate, the sudden loss of a drive unit of the drive arrangement, which shall also be called herein a "breakaway of the drive unit", may lead to an unexpected dropping of the tailgate. This occurs for example in event of a breakage of a drive unit connection of one of the drive units. Such a condition shall be called herein an "error condition".

In a known drive arrangement (DE 10 2008 022 870 B3), there are proposed in one variant a purely motor-operated drive unit and, separate from this, a purely spring-operated drive unit. In order to be able to detect an error condition in the purely spring-operated drive unit, an electrical signal of the purely motor-operated drive unit is monitored. The detecting of an error condition pertaining to the purely motor-operated drive unit is not provided here.

Another known drive arrangement (DE 10 2008 057 014 A1) is aimed at detecting an error condition affecting an at least also motor-operated drive unit. In addition, a spring drive unit is provided, which can be integrated in the motor-operated drive unit or also be provided separately therefrom.

In the known drive arrangements the problem arises that the detecting of an error condition on the part of the motor-operated drive units is often unsatisfactory. For example, a breakaway of a purely motor-operated drive unit with the tailgate located in the open position can hardly be detected by a control system, since this breakaway is not necessarily accompanied by a compensating movement of the drive unit, which could be detected per se as an error condition.

SUMMARY

A problem which the disclosure proposes to solve is to design and modify the known drive arrangement such that the detection of error conditions is optimized.

The above problem is solved according to the disclosure.

First of all, a feature of the proposed drive arrangement is the combining of a motor and spring-operated drive unit with a purely spring-operated drive unit. Although this produces a certain redundancy in regard to the corresponding drive unit springs which are present twofold, this also improves the ability to detect error conditions. Namely, it is proposed that, in event of a breakaway of the motor and spring-operated drive unit, the drive unit spring there always provides for a compensating movement, which can be detected as an error condition. On the other hand, upon breakaway of the purely spring-operated drive unit there is a reduction in the spring force acting on the tailgate and the weight of the flap usually produces a compensating movement of the motor and spring-operated drive unit, which can be detected as an error condition.

Based on the above, fundamental structure of the proposed drive arrangement, it has furthermore been discovered that it is enough to outfit only the motor and spring-operated drive unit with a movement sensor for the detecting of the two aforementioned error conditions. The detecting of a predetermined deviation of the sensor signal of the movement sensor from a predetermined normal signal, corresponding to the normal condition, as an error condition is carried out by a drive unit controller, which upon detecting such an error condition carries out a corresponding error routine.

Summarizing, the first teaching of the proposal is a combination of a special structure of the drive arrangement with a special kind of control system detection of an error condition, namely such that the error conditions affecting the two drive units can be reliably detected.

In an embodiment, the drive unit controller detects, from the sensor signal of the movement sensor, a movement of the drive connections of the first drive unit beyond a predetermined normal movement range, corresponding to the normal condition, as an error condition. In event of a breakaway of the motor and spring-operated drive unit, this means that the drive connections are moved by the drive unit spring to a position which can never be attained in the normal condition, i.e., when the drive unit is mounted in place. This variant can be especially easily detected by a control system, without requiring costly signal processing.

The last mentioned variant for the first mentioned teaching is subject matter of a further teaching, in which the existence of two drive units is not necessary. Instead, the detecting of an error condition is disclosed based on the exceeding of the normal movement range as such. One may refer alternately to the remarks on the two teachings.

The proposed solution can be realized in especially compact manner such that at least one drive unit is designed as a spindle drive unit and at least one drive unit is designed as a gas pressure spring. A good utilization of design space can be achieved in that the two drive units are arranged at two opposite sides of a tailgate opening associated with the tailgate.

The movement information forming the basis for the detecting of the error condition can be realized in entirely different manner. In some embodiments, the movement sensor for generating the sensor signal comprises a sensor element. Alternatively, however, according to some embodiments, it can be provided that the movement sensor merely comprises an evaluation unit for evaluation of a motor current of the drive unit motor. Accordingly, the term "movement sensor" should be construed broadly.

An embodiment concerns the breakaway of the first drive unit in which a compensating movement always occurs between the two drive connections of the first drive unit. The compensating movement may be propelled by the drive unit spring and/or by the drive unit motor of the first drive unit. Such a compensating movement always involves a deviation of the sensor signal of the movement sensor from a normal signal corresponding to the normal condition and is accordingly detected by the drive unit controller as an error condition.

There are various variants for the checking of the compensating movement in regard to the occurrence of an error condition. In some embodiments, the compensating movement lies at least in part outside the normal movement range, which is detected by the drive arrangement as an error condition.

In some embodiments, the drive unit controller in the course of the compensating movement detects a predetermined deviation of the signal curve of the sensor signal of the movement sensor from a predetermined normal curve corresponding to the normal condition as an error condition.

Both variants enable the detecting of an error condition without requiring costly signal processing measures.

According to various embodiments, a tailgate arrangement is disclosed in its own right with a tailgate which can be moved between a closed position and an open position.

It is important that the tailgate arrangement is outfitted with a drive arrangement according to one of the first mentioned teachings that is associated with the tailgate. One may refer to the remarks in this regard.

Various embodiments provide a drive arrangement for the motorized movement of a tailgate of a motor vehicle, comprising at least one drive unit having two drive connections for channeling out drive unit power, wherein the drive connections in the installed state are coupled in terms of drive to the tailgate, wherein a first drive unit is motor and spring-operated and has a drive unit motor as well as a drive unit spring, each acting on the two drive connections associated with the first drive unit, wherein the first drive unit comprises a movement sensor for generating a sensor signal, representing movement information regarding a movement between the drive connections of the first drive unit, wherein the first drive unit is configured to be non-self-locking with respect to the two drive connections, wherein a second drive unit is solely spring-operated and has a drive unit spring, which acts on the two drive connections associated with the second drive unit, wherein a drive unit controller is provided, which detects a predetermined deviation of the sensor signal of the movement sensor from a predetermined normal signal corresponding to the normal condition as an error condition and upon detecting an error condition carries out an error routine.

In various embodiments, in the mounted state, the first drive unit and the second drive unit are arranged on two opposite sides of a tailgate opening associated with the tailgate.

In various embodiments, the drive unit controller detects, from the sensor signal of the movement sensor, a movement between the drive connections of the first drive unit beyond a predetermined normal movement range, corresponding to the normal condition, as an error condition.

Various embodiments provide a drive arrangement for the motorized movement of a tailgate of a motor vehicle, especially as described herein, wherein at least one drive unit is provided, having two drive connections for channeling out drive unit power, wherein the drive connections in the installed state are coupled in terms of drive to the tailgate, wherein the drive unit or one of the drive units comprises a movement sensor for generating a sensor signal, representing movement information regarding a movement between the drive connections of the drive unit, wherein a drive unit controller is provided, which detects, from the sensor signal of the movement sensor, a movement between the drive connections beyond a predetermined normal movement range, corresponding to the normal condition, as an error condition and upon detecting an error condition carries out an error routine.

In various embodiments, at least one drive unit, especially the first drive unit, is designed as a spindle drive unit, and/or at least one drive unit, especially the second drive unit, is designed as a gas pressure spring.

In various embodiments, the movement information associated with the movement sensor is the movement distance, the movement velocity or the movement acceleration of the respective drive connections relative to each other.

In various embodiments, the movement sensor for generating the sensor signal comprises a sensor element, especially an incremental shaft encoder, or the movement sensor for generating the sensor signal comprises an evaluation unit for evaluating a motor signal of the drive unit motor, especially a motor current or a motor voltage of the drive unit motor.

In various embodiments, an error-caused, especially sudden, releasing of the coupling in terms of drive between the first drive unit and the tailgate triggers a compensating movement between the two drive connections of the first drive unit, which is propelled by the drive unit spring and/or by the drive unit motor of the first drive unit and is detected by the drive unit controller as an error condition.

In various embodiments, the compensating movement lies at least in part outside a normal movement range and is detected as an error condition by the drive unit controller through the resulting sensor signal of the movement sensor, wherein the compensating movement leads to an end position, and further wherein the end position is a blocking position which is determined by a blocking end stop between the two drive connections.

In various embodiments, the drive unit controller in the course of the compensating movement detects a predetermined deviation of the signal curve of the sensor signal of the movement sensor from a predetermined normal curve corresponding to the normal condition as an error condition, wherein the drive unit controller detects a temporal change in the sensor signal with a slope greater than a predetermined error slope as an error condition.

In various embodiments, the drive unit controller in the error routine carries out a braking of the first drive unit and/or the drive unit controller in the error routine sends a warning message.

Various embodiments provide a tailgate arrangement with a tailgate, which can be moved between a closed position and an open position, and with a drive arrangement associated with the tailgate as described herein.

BRIEF DESCRIPTION OF THE DRAWINGS

In the following, the disclosure shall be explained more closely with the aid of drawings showing only one sample embodiment. In the drawings.

during the motorized opening movement of the tailgate, each time in regard to the movement of the first drive unit

DETAILED DESCRIPTION

Figure 1:
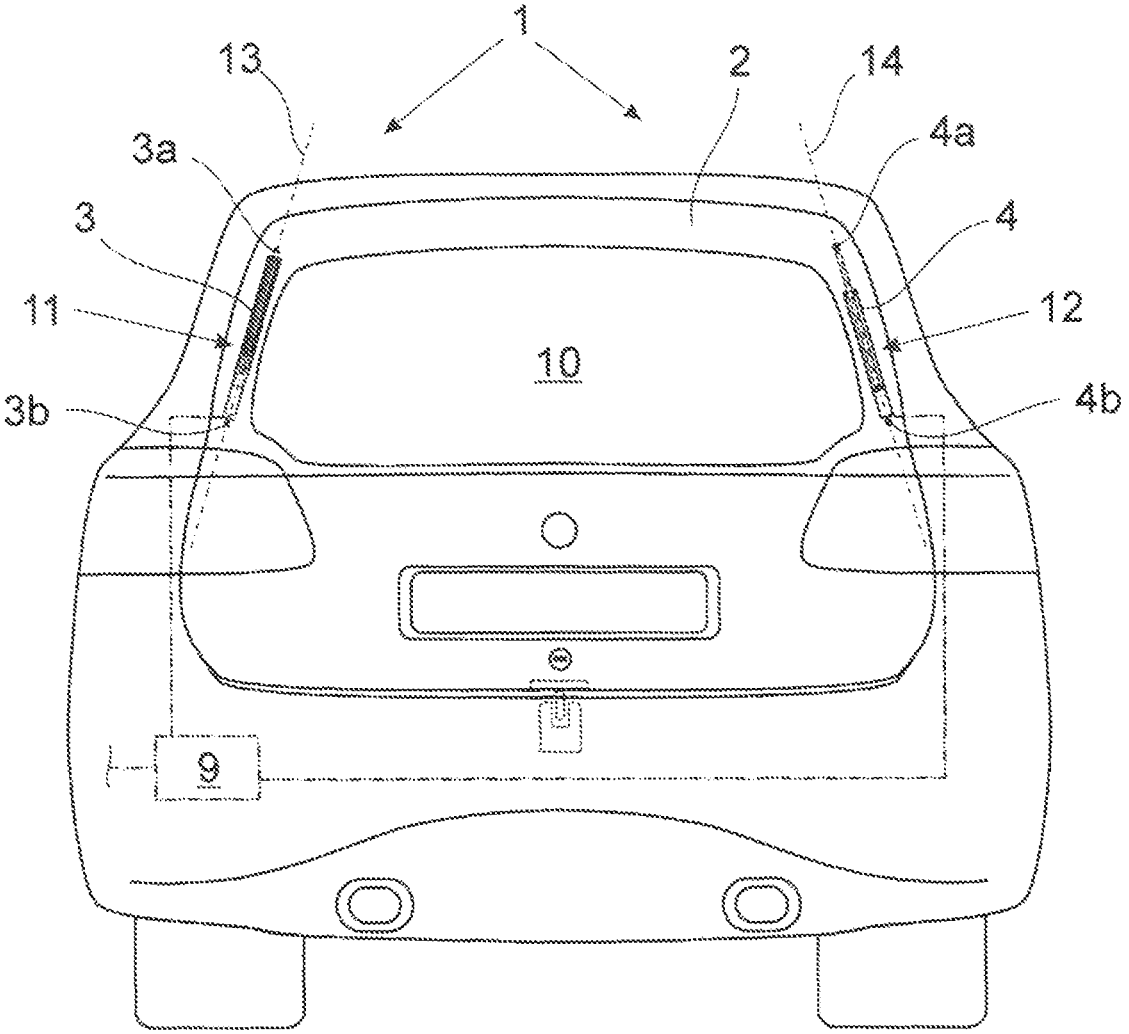
FIG. 1 is a rear view of a motor vehicle with a drive arrangement as proposed, wherein the tailgate of the motor vehicle is represented as being transparent, FIG. 2 a) depicts the first, motor and spring-operated drive unit and b) illustrates the second, exclusively spring-operated drive unit of the drive arrangement according to FIG. 1, each time in longitudinal section.

The drive arrangement 1 represented in the drawing serves for the motorized movement of a tailgate 2 of a motor vehicle. In order to generate the drive unit power required for this, at least one drive unit 3, 4 is provided. Here, two drive units 3, 4 are provided, each of which has two drive connections 3*a*, 3*b*, 4*a*, 4*b* for channeling out the drive unit power. The drive connections 3*a*, 3*b*, 4*a*, 4*b* are coupled in terms of drive to the tailgate 2 in the installed state shown in FIG. 1. For this, the drive connections 3*a*, 3*b*, 4*a*, 4*b* in the sample embodiment represented are each part of a ball pin/ball socket mounting.

A first drive unit 3, 4 of the two drive units 3, 4, which is represented on the left in FIG. 1 and in FIG. 2*a*), is motor and spring-operated and accordingly has a drive unit motor 5 as well as a drive unit spring 6, each acting on the two drive connections 3*a*, 3*b* associated with the first drive unit 3.

The first drive unit 3 moreover comprises a movement sensor 7 for generating a sensor signal, representing movement information regarding a movement between the drive connections 3*a*, 3*b* of the first drive unit 3.

The first drive unit 3 moreover is configured to be non-self-locking with respect to the two drive connections 3*a*, 3*b*. This means that the drive unit 3 when the drive unit motor 5 is not energized can be moved by applying force to the drive connections 3*a*, 3*b*.

The second drive unit 4, which is represented on the right in FIG. 1 and in FIG. 2*b*), is solely spring-operated and accordingly has a drive unit spring 8, which acts on the two drive connections 4*a*, 4*b* associated with the second drive unit 4.

The drive arrangement 1 is part of a proposed tailgate arrangement, which is associated with the tailgate 2. The tailgate 2 can be moved in motorized manner between a closed position and an open position by means of the drive arrangement 1. The movement in the opening direction, i.e., in the direction of the open position, can occur against the weight of the tailgate 2.

The drive unit springs 6, 8 of the two drive units 3, 4 work against the weight of the tailgate 2 at least for a portion of the movement path of the tailgate 2, so that a relatively low motorized drive unit power is required for the opening of the tailgate 2.

In the open position of the tailgate 2, a state of equilibrium can be produced, such that the tailgate 2 maintains itself even when the drive unit 3 is not energized. Accordingly, the arrangement is such that the weight force, the spring forces of the drive unit springs 6, 8, and the friction forces prevailing in the respective drive unit trains just cancel out.

An interesting fact about the proposed solution is that both a breakaway of the first drive unit 3 and a breakaway of the second drive unit 4 result in a compensating movement of the first drive unit 3, which deviates from a normal condition.

The normal condition can be defined such that all drive connections 3*a*, 3*b*, 4*a*, 4*b* for normal operation use are coupled in terms of drive with the tailgate 2.

Accordingly, it is proposed that a drive unit controller 9 is provided, which detects a predetermined deviation of the sensor signal S of the movement sensor 7 from a predetermined normal signal N corresponding to the normal condition as an error condition and upon detecting an error condition carries out an error routine. The normal signal N can be stored in the drive unit controller 9. This may occur by storing individual signal values, by storing a signal description of any kind, or so on.

Figure 2:
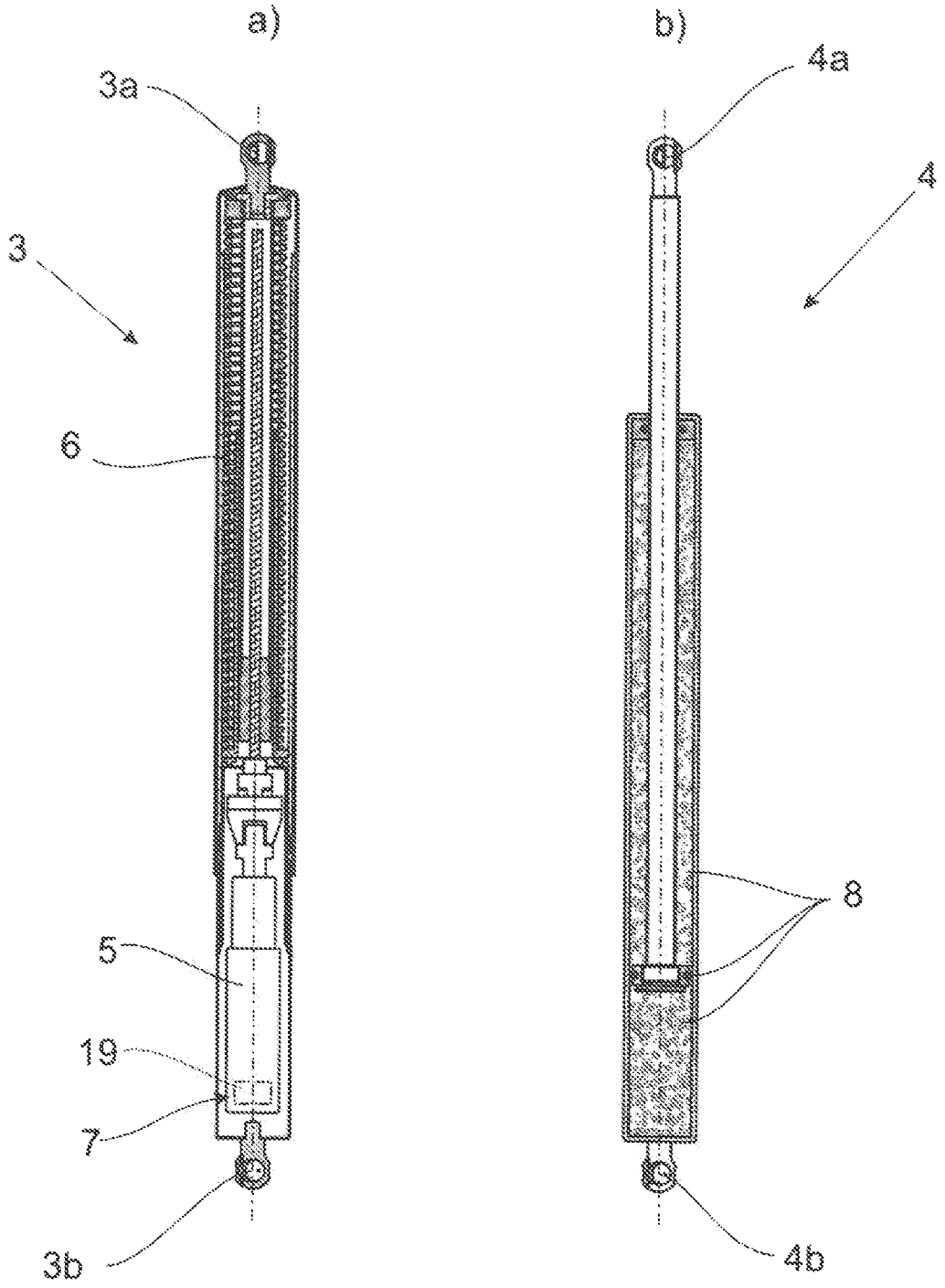

One will note from the representation per FIG. 1 that in the mounted state the first drive unit 3 and the second drive unit 4 are arranged on two opposite sides of a tailgate opening 10 associated with the tailgate 2. In various embodiments, the two drive units 3, 4, as shown in FIG. 2, are each configured to be oblong in shape and the two oblong drive units 3, 4 in the mounted state are arranged lengthwise to each other. In some embodiments, the two drive units 3, 4 are each situated in a rain gutter 11, 12, which is located in each case at the side of the tailgate opening 10, when the tailgate 2 is in the closed position.

The two drive units 3, 4 are each designed as linear drive units, so that the respectively associated drive connections 3*a*, 3*b*, 4*a*, 4*b* can be moved along a linear axis 13, 14.

In the sample embodiment shown, the extending of the first drive unit 3 brings about an opening movement of the tailgate 2, while the retracting of the drive unit 3 brings about a closing movement of the tailgate 2.

An especially easy variant to be realized in terms of control technique for the detecting of an error condition consists in that the drive unit controller 9 detects, from the sensor signal S of the movement sensor 7, a movement between the drive connections 3*a*, 3*b* of the first drive unit 3 beyond a predetermined normal movement range 15, corresponding to the normal condition, as an error condition. This is shown schematically in the representation per FIG. 4.

Figure 4:
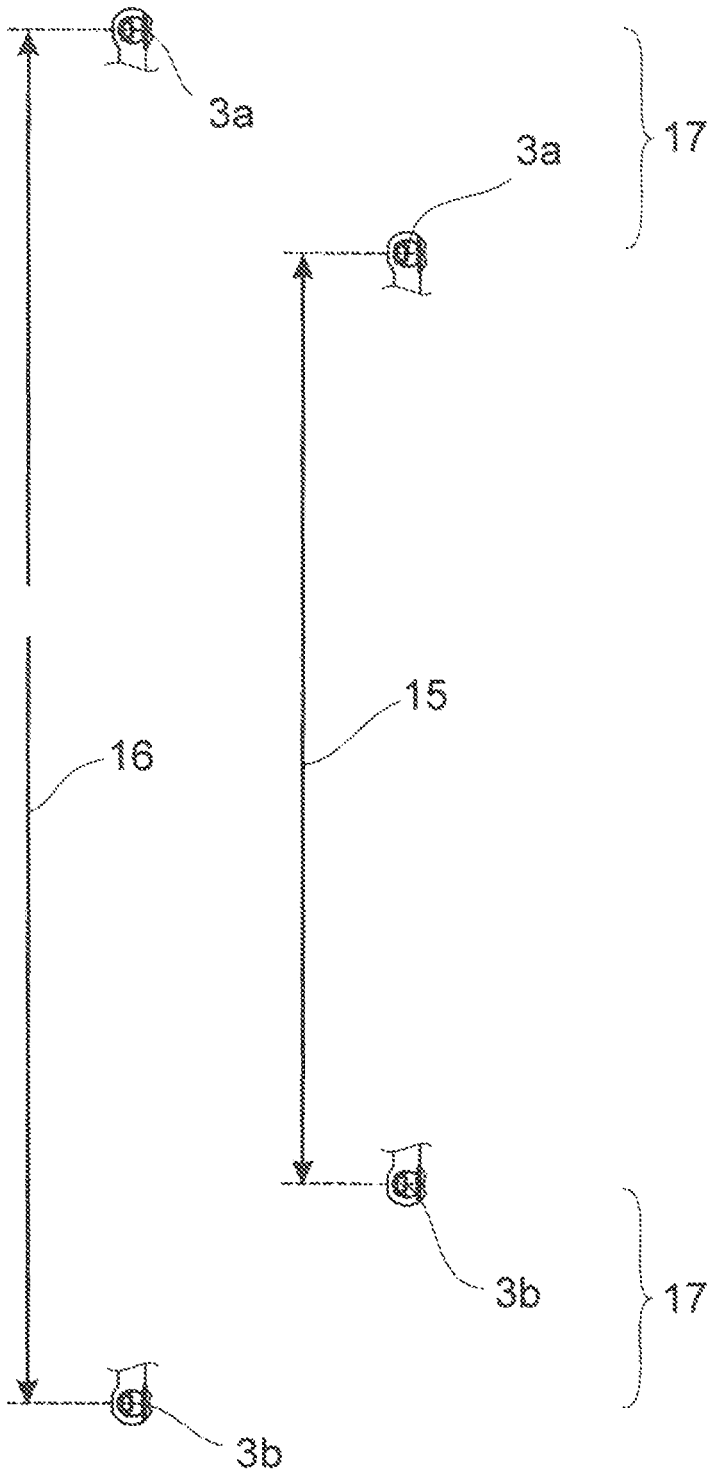
FIG. 4 shows different movement ranges of the first drive unit in a highly schematic representation.

FIG. 4 shows first of all the maximum movement range 16 of the first drive unit 3. The maximum movement range 16 is produced by the maximum movement capacity of the first drive unit 3 in its unmounted state.

In the mounted state of the first drive unit 3, due to the kinematics of the tailgate 2 there is a limited maximum movement capacity of the first drive unit 3. This limited movement capacity is shown in FIG. 4 by the normal movement range 15.

FIG. 4 further shows that in the mounted state unpermitted movement ranges 17, 18 occur, the entering of which in the mounted state is precluded by the kinematics of the tailgate 2. In the event that a movement is found from the sensor signal S of the movement sensor 7 between the drive connections 3*a*, 3*b* in an unpermitted movement range 17, 18, it can be deduced that the drive unit 3 must have broken away, which in turn is detected by means of the drive unit controller 9 as an error condition.

The latter detecting of an error condition, which can be implemented with especially simple control techniques, is the subject matter of a further independent teaching. In the drive arrangement 1 according to this further teaching, it does not matter whether one drive unit 3 is provided or whether several drive units 3, 4 are provided. The only thing that is important is that the drive unit controller 9 detects, from the sensor signal S of the movement sensor 7, a movement between the drive connections 3*a*, 3*b* beyond a predetermined normal movement range 15, corresponding to the normal condition, as an error condition and upon detecting an error condition carries out an error routine.

An especially compact design results in that at least one drive unit 3, here the first drive unit 3, is designed as a spindle drive unit, as is shown in FIG. 2*a*), which is outfitted with a spindle/screw nut gearing for the generating of drive unit movements. Alternatively or additionally it may be provided that at least one drive unit 4, here the second drive unit 4, is designed as a gas pressure spring. Insofar, as represented here, as the first drive unit 3 is designed as a spindle drive unit and the second drive unit 4 as a gas pressure spring, the advantage arises that both drive units 3, 4 have a similar oblong shape. This makes possible a symmetrical design of the drive arrangement 1, which is not only visually attractive but also may be advantageous in terms of the resulting distribution of the drive unit forces.

Depending on the movement sensor 7 which is used, the movement information in question may be the movement distance, the movement velocity or the movement acceleration of the respective drive connections 3*a*, 3*b* relative to each other.

Here, the movement sensor 7 for generating the sensor signal S has a sensor element 19, from which the drive unit controller 9 determines the corresponding movement information, here, the movement velocity. It may be provided in this case, for example, that the movement information is derived from the sensor signal S of a shaft encoder, which is associated with a drive unit shaft of the drive unit motor 5 of the first drive unit 3. Knowing the transmission ratio of the spindle/screw nut gearing, it is deduced from the sensor signal S the movement distance or the movement velocity or the movement acceleration of the respective drive connections 3*a*, 3*b* with respect to each other. Basically, however, the sensor signal S may also directly represent information as to the lengthening of the drive unit 3, designed here as a spindle drive unit.

In the sample embodiment shown, the sensor element 19 is an incremental shaft encoder, which is designed as a Hall sensor, an MR sensor, an optical sensor or the like.

Alternatively, it may also be provided that the movement sensor 7 for generating the sensor signal S comprises an evaluation unit (not shown) for evaluating a motor signal, especially a motor current or a motor voltage, of the drive unit motor 5. This includes, for example, the detection of movement information based on the current ripple of a D.C. motor or the like.

As mentioned above, in the present instance the breakaway of one of the drive units 3, 4 as an error condition is the primary concern. In this case, an error-caused, especially sudden, releasing of the coupling in terms of drive between the first drive unit 3 and the tailgate 2 triggers a compensating movement between the two drive connections 3*a*, 3*b* of the first drive unit 3. This compensating movement may be propelled by the drive unit spring 6 of the first drive unit 3. Alternatively or additionally, it may also be provided that the compensating movement is propelled by the drive unit motor 5 of the first drive unit 3, especially if the breakaway of the first drive unit 3 occurs during the motorized movement of the tailgate 2.

In all cases, the occurrence of the compensating movement is a sign that an error condition is present. Accordingly, it can be provided that the compensating movement is detected by the drive unit controller 9 as an error condition through the sensor signal S.

In the simple case discussed further above, the compensating movement lies at least in part outside the normal movement range 15, which is detected as an error condition by the drive unit controller 9 through the resulting sensor signal S of the movement sensor 7 (FIG. 4). In various embodiments, the compensating movement leads to an end position in which the first drive unit 3 occupies the maximum position shown on the left in FIG. 4. In various embodiments, the end position is a blocking position, which is determined by a blocking end stop between the two drive connections 3*a*, 3*b*. Lastly, the drive unit spring 6 of the first drive unit 3 can force the first drive unit 3 into the blocking position.

Alternatively or additionally, it may be provided that the drive unit controller 9 in the course of the compensating movement detects a predetermined deviation of the signal curve of the sensor signal S of the movement sensor 7 from a predetermined normal curve corresponding to the normal condition as an error condition. In various embodiments, the drive unit controller 9 detects a temporal change in the sensor signal with a slope greater than a predetermined error slope as an error condition.

Figure 3:
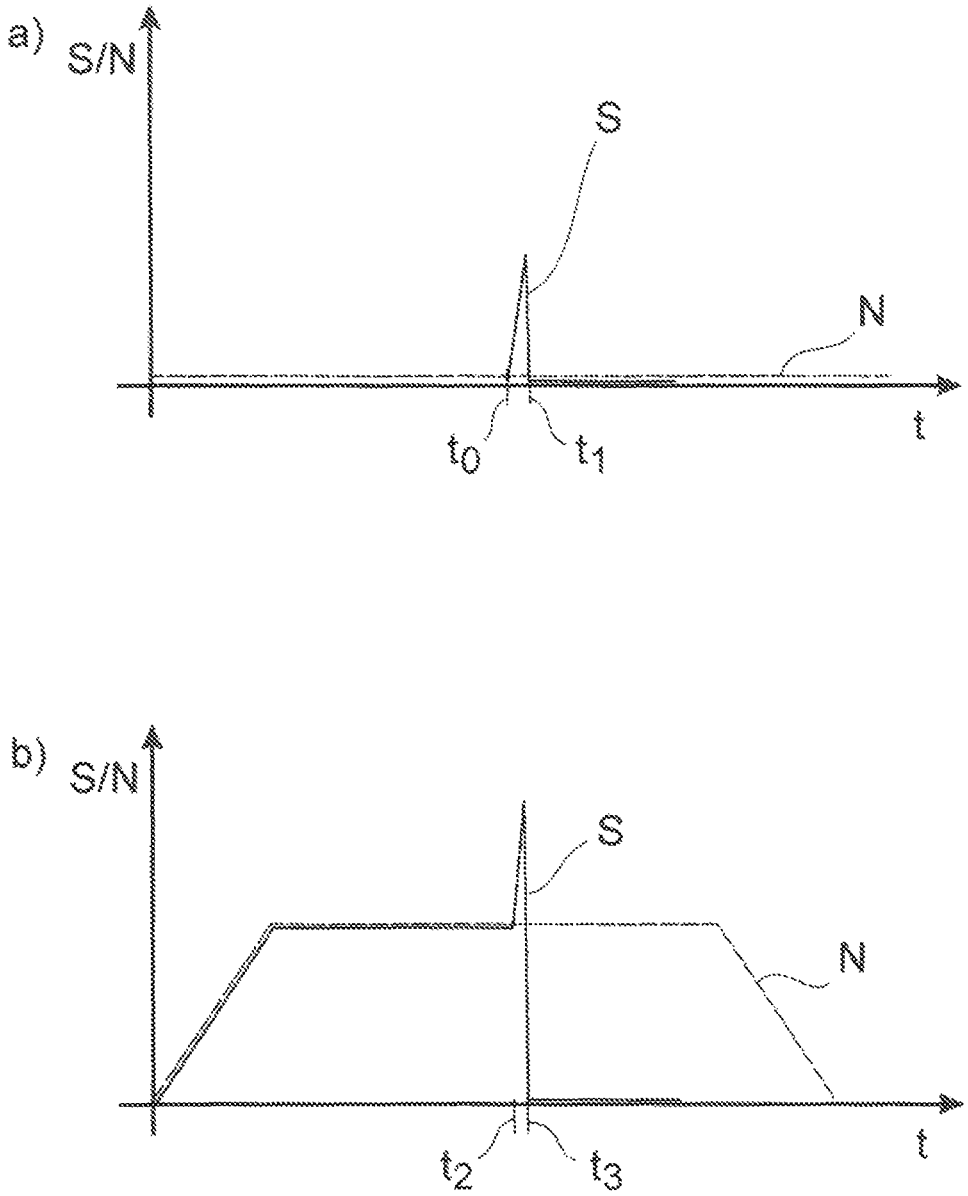
FIG. 3 illustrates the situation of a breakaway of the first drive unit a) from the open position of the tailgate and b)

FIG. 3 shows two variants for a monitoring of the signal curve of the sensor signal S of the movement sensor 7 (solid line) and the normal signal (dotted line). In both variants, the sensor signal and the normal signal, each representing the curve of the movement velocity of the first drive unit 3, are plotted against time.

FIG. 3*a*) shows the situation of the tailgate 2 situated in the open position, in which the first drive unit 3 breaks away at time $t_0$. The breakaway is connected with a sudden acceleration of the first drive unit 3, until the first drive unit 3 at time $t_1$ is blocked in the blocking position shown on the left in FIG. 4. This compensating movement is produced here solely by the drive unit spring 6 of the first drive unit 3. Because the movement velocity far exceeds a velocity threshold representing the normal condition, this condition is detected as an error condition. The movement velocity corresponding to the normal condition here has a zero value, since the tailgate 2 is supposed to be merely held in the open position.

The situation shown in FIG. 3*b*) involves the motorized opening process of the tailgate 2, where the first drive unit 3 breaks away at time $t_2$. At time $t_2$ both the drive unit motor 5 and the drive unit spring 6 of the first drive unit 3 are working in the opening direction of the tailgate 2, so that the resulting compensating movement is once again connected to a movement of the drive unit 3 into the blocking position represented in FIG. 4 on the left. The compensating movement is now propelled both by the drive unit motor 5 and by the drive unit spring 6 of the first drive unit 3. The detecting of the error condition can be easily deduced from the deviation of the movement velocity from the movement velocity corresponding to the normal condition, represented by the dotted line, i.e., the normal signal.

Various possibilities are conceivable for responding in the context of the error routine to the detecting of the error condition. In various embodiments, the drive unit controller 9 in the error routine carries out a braking of the first drive unit 3. Alternatively or additionally, it may be provided that the drive unit controller 9 in the error routine sends a warning message, so that the operator can avoid a collision with the tailgate 2 by a corresponding evasive movement. Such a warning message may be provided optically by corresponding display elements, acoustically by a warning sound, a voice announcement, or the like, or haptically, for example by a vibrating of a radio remote control or the like.

According to a further teaching, the tailgate arrangement is disclosed in its own right with the tailgate 2 which can be moved between a closed position and an open position, and with a drive arrangement 1 according to one of the two aforementioned teachings that is associated with the tailgate 2. One may refer to all the remarks on the two aforementioned teachings.

The invention claimed is:

1. A drive arrangement for the motorized movement of a tailgate of a motor vehicle, comprising at least one drive unit and a drive unit controller, the at least one drive unit having two drive connections for channeling out drive unit power, wherein the drive connections in an installed state are coupled in terms of drive to the tailgate, wherein a first drive unit is motor and spring-operated and has a drive unit motor as well as a drive unit spring, each acting on the two drive connections associated with the first drive unit in parallel, wherein the first drive unit is designed as a spindle unit, which is outfitted with a spindle/screw nut gearing for generating of drive unit movements and acting on the two drive connections associated with the first drive unit, wherein the first drive unit comprises a movement sensor for generating a sensor signal, representing movement information regarding a movement between the drive connections of the first drive unit, wherein the first drive unit is configured to be non-self-locking with respect to the two drive connections, wherein a second drive unit is solely spring-operated and has a drive unit spring, which acts on the two drive connections associated with the second drive unit, wherein the drive unit controller detects a predetermined deviation of the sensor signal of the movement sensor from a predetermined normal signal corresponding to the normal condition as an error condition and upon detecting an error condition carries out an error routine.

2. The drive arrangement as claimed in claim 1, wherein, in the mounted state, the first drive unit and the second drive unit are arranged on two opposite sides of a tailgate opening associated with the tailgate.

3. The drive arrangement as claimed in claim 1, wherein the drive unit controller detects, from the sensor signal of the movement sensor, a movement between the drive connections of the first drive unit beyond a predetermined normal movement range, corresponding to the normal condition, as an error condition.

4. The drive arrangement as claimed in claim 1, wherein at least one drive unit is designed as a gas pressure spring.

5. The drive arrangement as claimed in claim 1, wherein the movement information associated with the movement sensor is a movement distance, a movement velocity or a movement acceleration of the respective drive connections relative to each other.

6. The drive arrangement as claimed in claim 1, wherein the movement sensor for generating the sensor signal comprises a sensor element, especially an incremental shaft encoder, or the movement sensor for generating the sensor signal comprises an evaluation unit for evaluating a motor signal of the drive unit motor.

7. The drive arrangement as claimed in claim 1, wherein an error-caused releasing of the coupling in terms of drive between the first drive unit and the tailgate triggers a compensating movement between the two drive connections of the first drive unit, which is propelled by the drive unit spring and/or by the drive unit motor of the first drive unit and is detected by the drive unit controller as an error condition.

8. The drive arrangement as claimed in claim 7, wherein the compensating movement lies at least in part outside a normal movement range and is detected as an error condition by the drive unit controller through a resulting sensor signal of the movement sensor.

9. The drive arrangement as claimed in claim 7, wherein the drive unit controller during the compensating movement detects a predetermined deviation of the signal curve of the sensor signal of the movement sensor from a predetermined normal curve corresponding to the normal condition as an error condition.

10. The drive arrangement as claimed in claim 1, wherein the drive unit controller in the error routine carries out a braking of the first drive unit and/or the drive unit controller in the error routine sends a warning message.

11. A tailgate arrangement comprising:

a tailgate, which is configured to be moved between a closed position and an open position, and a drive arrangement associated with the tailgate as claimed in claim 1.

12. The drive arrangement as claimed in claim 1, wherein the movement sensor for generating the sensor signal comprises an incremental shaft encoder, or the movement sensor for generating the sensor signal comprises an evaluation unit for evaluating a motor signal of the drive unit motor, a motor current or a motor voltage of the drive unit motor.

13. The drive arrangement as claimed in claim 8, wherein the compensating movement leads to an end position.

14. The drive arrangement as claimed in claim 13, wherein the end position is a blocking position which is determined by a blocking end stop between the two drive connections.

15. The drive arrangement as claimed in claim 9, wherein the drive unit controller detects a temporal change in the sensor signal with a slope greater than a predetermined error slope as an error condition.

16. A drive arrangement for the motorized movement of a tailgate of a motor vehicle, comprising at least one drive unit and a drive unit controller, wherein the drive unit comprises two drive connections for channeling out drive unit power, wherein the drive connections in an installed state are coupled in terms of drive to the tailgate, wherein the drive unit is designed as a spindle unit, which is outfitted with a spindle/screw nut gearing for generating of drive unit movements and acting on the two drive connections associated with the drive unit, wherein the drive unit or one of the drive units comprises a movement sensor for generating a sensor signal, representing movement information regarding a movement between the drive connections of the drive unit, wherein the drive unit controller detects, from the sensor signal of the movement sensor, a movement between the drive connections beyond a predetermined normal movement range, corresponding to the normal condition, as an error condition and upon detecting an error condition carries out an error routine.

* * * * *